US006427937B1

(12) United States Patent
Rabe

(10) Patent No.: US 6,427,937 B1
(45) Date of Patent: Aug. 6, 2002

(54) APPARATUS FOR MANIPULATING A BOBBIN AT A WINDING MACHINE

(75) Inventor: Helmut Rabe, Wehretal (DE)

(73) Assignee: Georg Sahm GmbH & Co. KG Maschinenfabrik, Eschwege (DE)

( * ) Notice: Subject to any disclaimer, the term of this patent is extended or adjusted under 35 U.S.C. 154(b) by 0 days.

(21) Appl. No.: 09/646,717

(22) PCT Filed: May 5, 1999

(86) PCT No.: PCT/EP99/03081

§ 371 (c)(1),
(2), (4) Date: Sep. 21, 2000

(87) PCT Pub. No.: WO99/57052

PCT Pub. Date: Nov. 11, 1999

(30) Foreign Application Priority Data

May 6, 1998 (DE) ..... 198 20 242
Jun. 18, 1998 (DE) ..... 198 27 240

(51) Int. Cl.[7] ..... B65H 54/22; B65H 67/00
(52) U.S. Cl. ..... 242/473.9; 242/561
(58) Field of Search ..... 242/473.9, 473.5, 242/129, 559, 561

(56) References Cited

U.S. PATENT DOCUMENTS 1,980,138 A 11/1934 Johnson et al.
3,807,647 A * 4/1974 Miller ..... 242/485.9
3,918,650 A 11/1975 Kemel
4,007,884 A * 2/1977 Schippers et al. ..... 242/473.9
4,157,792 A 6/1979 Wyckhuys
4,398,677 A * 8/1983 Henrich ..... 242/473.5 X
4,611,707 A * 9/1986 Wedler ..... 242/473.9 X
5,165,615 A * 11/1992 Polnik ..... 242/473.9 X
5,248,104 A * 9/1993 Groos et al. ..... 242/420.6
5,797,557 A 8/1998 Wang et al.

FOREIGN PATENT DOCUMENTS

| | | |
|---|---|---|
| EP | 0 025 128 | 3/1981 |
| EP | 0 094 784 | 11/1983 |
| FR | 2 376 811 | 8/1978 |
| GB | 1 463 222 | 2/1977 |
| JP | 63-112379 | 5/1988 |
| JP | 03-284586 | 12/1991 |

* cited by examiner

*Primary Examiner*—Michael R. Mansen
(74) *Attorney, Agent, or Firm*—Merchant & Gould P.C.

(57) ABSTRACT

An apparatus for manipulating a bobbin, in particular flanged bobbin at a winding machine, which includes a doffing carriage with lifting devices to raise and lower a bobbin between a winding height, at which the bobbin can be pushed onto or pulled off a chuck of the winding machine, and a transport height, at which the bobbin can be rolled while resting on a floor or on a conveyor belt running in front of the winding machine. Guide mechanisms are provided for the low-friction guidance of the doffing carriage with or without raised bobbin in a transport direction parallel to the chuck, between a winding position for winding the bobbin and a transport position in which the bobbin is transported to or away from the machine.

14 Claims, 4 Drawing Sheets

APPARATUS FOR MANIPULATING A BOBBIN AT A WINDING MACHINE

TECHNICAL FIELD

The invention relates to an apparatus for manipulating a bobbin, in particular a flanged bobbin at a winding machine according to the precharacterizing clause of claim 1.

BACKGROUND

To wind threads, tapes, filaments or the like onto bobbins, winding machines are used that comprise a chuck onto which one or more bobbin tubes are set. The filamentary material is then wound onto the bobbin tube. As soon as the resulting package has reached a preset final diameter or a preset final weight, the package is taken off the chuck and stored or processed further. The process of taking away the completed package and replacing it with an unwound bobbin tube is called doffing.

For very large and heavy packages flanged bobbins are often used, with flanges so dimensioned that the package can be transported by resting it on the flanges and rolling it on the floor. To remove full packages from the chuck and also to set unwound bobbin tubes thereon, a freely movable doffing carriage is used, which grips the flanged bobbin, pulls it off (or pushes it onto) the chuck and sets it down on the floor (or raises it therefrom). The operation of this equipment is an elaborate procedure.

SUMMARY

The object of the invention is to disclose an apparatus with which to manipulate a package or bobbin at a winding machine that simplifies the doffing procedure, i.e. the process of exchanging a package for an empty bobbin.

This object is achieved by an apparatus according to claim 1.

It is an important point of the invention that guide mechanisms are provided for the low-friction guidance of the doffing carriage with or without raised package, so that the doffing carriage need not be moved on the floor, which obviously is associated with various problems. That is, to achieve the stated object a doffing carriage is provided with lifting devices to raise and lower a package or bobbin between a winding height, at which the bobbin can be pushed onto or pulled off a chuck of the winding machine, and a transport height, at which the package can be rolled while resting on the floor or on a conveyor belt running in front of the winding machine, wherein a guide mechanism is further provided for the low-friction guidance of the doffing carriage with or without raised bobbin in a transport direction parallel to the chuck, between a winding position for winding the bobbins and a transport position in which the bobbins or packages are transported towards or away from the machine.

Preferably the guide mechanism is fixedly attached to the winding machine in the transport direction. As a result, between the doffing carriage and the winding machine no forces can arise that could be exerted on the winding machine relative to the site where it is installed.

Preferably the lifting devices are designed to support the flanged bobbin at its two flanges so that no bending forces or moments of tilt act on the flanges. In the case of bobbins without flanges, the package is supported directly by way of the wound material.

The guide mechanism is preferably so constructed that when the bobbin is in the winding position, the lifting devices are in the region of the flanges, so that they do not interfere with the winding process.

The lifting devices are preferably so constructed that when the package is in the transport position, they release it and can be shifted into the winding position. The package is thus free and can be rolled or otherwise transported away.

Preferably the guide mechanisms comprise straight guides or telescopic guides which are attached to the winding machine. With this arrangement it is particularly simply and effectively ensured that when a wound package is taken off or an empty bobbin tube is put on, no forces are exerted on the winding machine relative to the site where it is installed.

Preferably the lifting devices for the bobbin comprise a pair of levers pivotably mounted on the doffing carriage, which with first gripping ends engage the flanges or, in the case of flangeless bobbins, grasp the package at its circumference, and which by way of second actuating ends can be moved so as to raise and lower the package, preferably by means of a common lifting cylinder. The axle about which the lever pivots corresponds to the axis of rotation of the telescopic guides. The gripping ends are so constructed that they can absorb forces acting in the direction of the chuck, inasmuch as the bobbin rests by way of both flanges on the elongated (in the direction of the chuck) lever ends. Therefore no moments of tilt act on the gripping ends.

The doffing carriage is preferably so constructed that it can be pushed manually, which enables simple manipulation. Because the guide mechanisms are so constructed as to generate little friction, therefore, it is ensured that the machine as a whole is easy to operate.

DESCRIPTION OF THE DRAWINGS

Further characteristics of the invention will be apparent from the subordinate claims and the following description of a preferred embodiment, which is explained in detail with reference to drawings, wherein

DETAILED DESCRIPTION

Figure 1B:
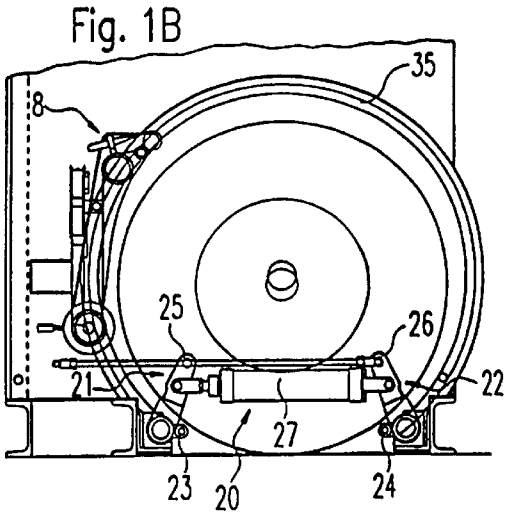
FIG. 1B is a side view of the embodiment shown in FIG. 1A.
Figure 2B:
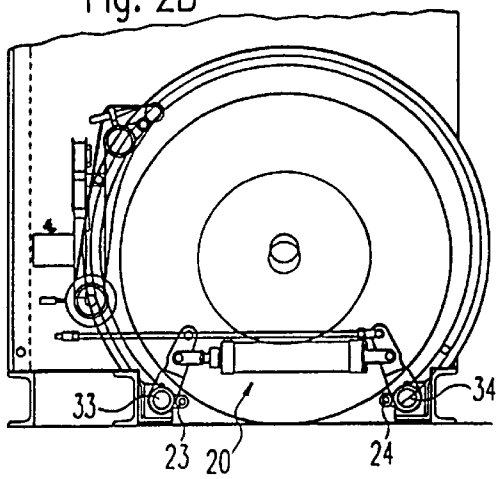
FIG. 2B is a side view of the embodiment shown in FIG. 2A.

In the following description, the same reference numerals are used for identical parts or parts with identical actions. The exemplary embodiment refers to flanged bobbins. Bobbins without flanges can also be manipulated in this way, however, if the material wound onto them is sufficiently stable.

Figure 1A:
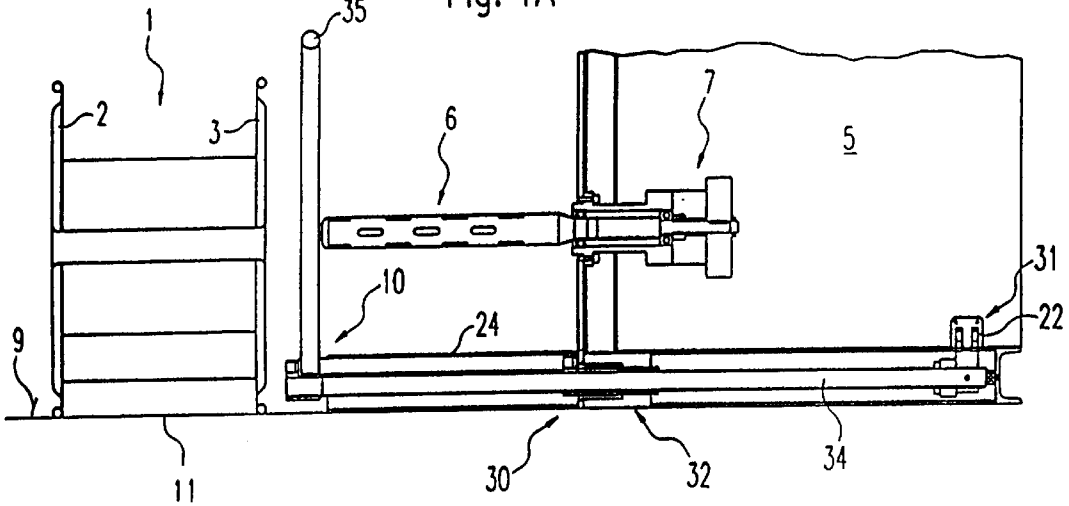
FIG. 1A illustrates, in elevation, an apparatus for manipulating a bobbin in accordance with an example embodiment of the invention, with the bobbin resting on the floor.
Figure 2A:
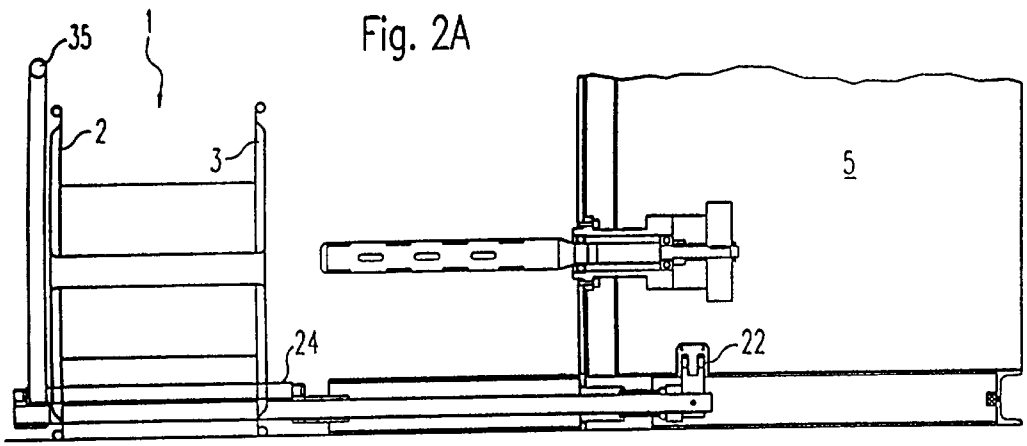
FIG. 2A illustrates the example apparatus of FIG. 1A, with a doffing carriage of the apparatus extended.
Figure 3B:
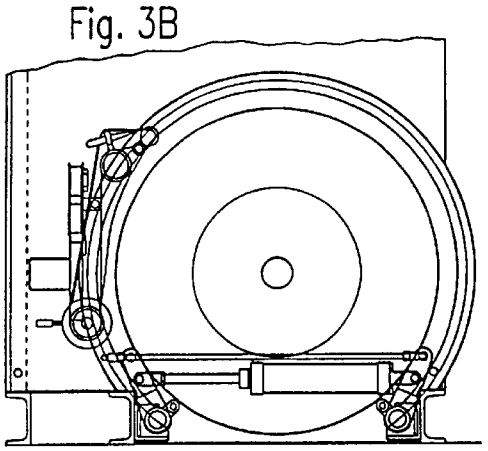
FIG. 3B is a side view of the embodiment shown in FIG. 3A.

In FIGS. 1A and 1B is shown the first placement of a bobbin tube, in which a flanged bobbin 1 with an outer flange 2 and an inner flange 3 is pushed onto a chuck 6 of a winding machine 5; the chuck 6 can be placed under tension by a tensioning means 7. A traversing arm 8 of the winding machine 5 is indicated only in the side views of FIGS. 1B to 8B.

At the winding machine 5, which stands on a floor 9, guide mechanisms 30 are provided which comprise inner, first bearings 31 that can be moved relative to the winding machine 5 and outer, second bearings that are fixed to the winding machine 5, as well as telescopic rods 33, 34 that run in the bearings 31 and 32. Together with lifting devices 20, these constitute a doffing carriage 10.

The lifting devices 20 Comprise a first lever 21 and a second lever 22. Both levers 21 and 22 comprise gripping ends 23 and 24, respectively, which are attached to the telescopic rods 33, 34 as are the levers 21 and 22. Whereas the levers 21, 22 are attached to inner (relative to the winding machine 5) ends of the telescopic rods 33, 34, the gripping ends 23, 24 are attached to the outer ends thereof and are made so long that the flanged bobbin 1 can rest on them by way of its two flanges 2 and 3.

Actuating ends 25 and 26 of the levers 21 and 22 are joined together by way of a common lifting cylinder 27, so that when the (short-distance) lifting cylinder is extended or retracted, the levers 21, 22 and with them the telescopic rods 33, 34 and hence also the gripping ends 23, 24 are pivoted.

At their outer (with respect to the machine) ends the telescopic rods 33, 34 are joined together by way of a handle 35 in the shape of a section of a ring so that here, in turn, a frame is formed that in itself is statically determined.

In the position shown in FIG. 1A, 1B the bobbin 1 with its flanges 2, 3 rests on the floor. The doffing carriage 10 is retracted into its inner position, the winding position. The lifting cylinder 27 as well as the levers 21 and 22 are fully withdrawn into the winding machine 5.

Figure 4B:
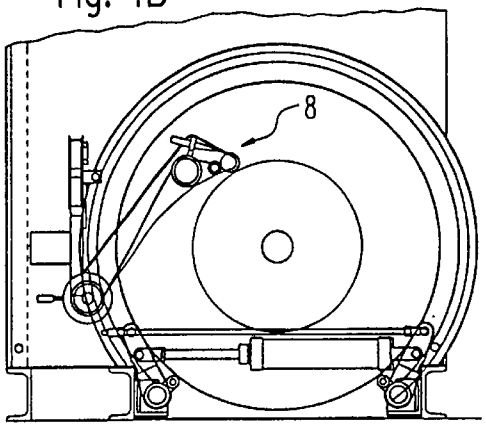
FIG. 4B is a side view of the embodiment shown in FIG. 4A.
Figure 3A:
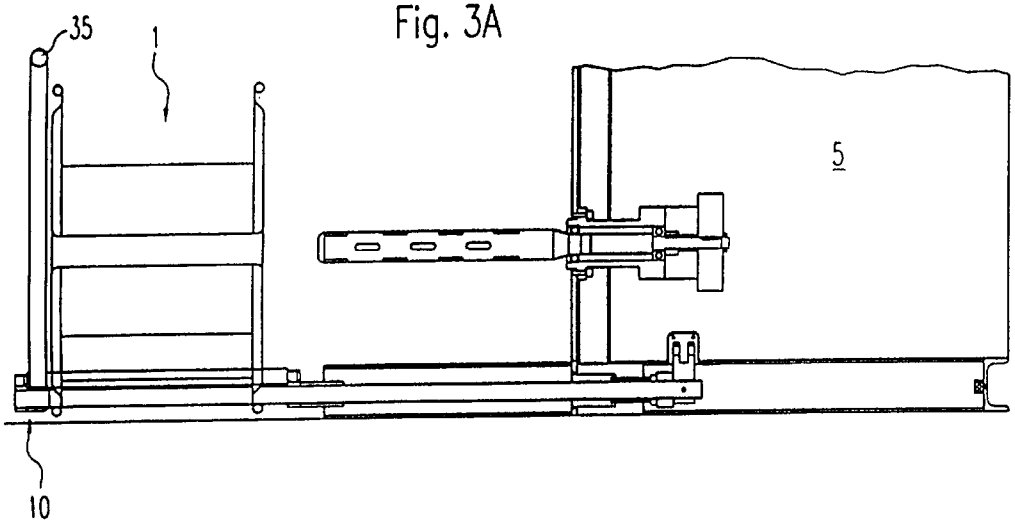
FIG. 3A illustrates the example apparatus as shown in FIG. 2A, with the bobbin raised onto the doffing carriage.
Figure 4A:
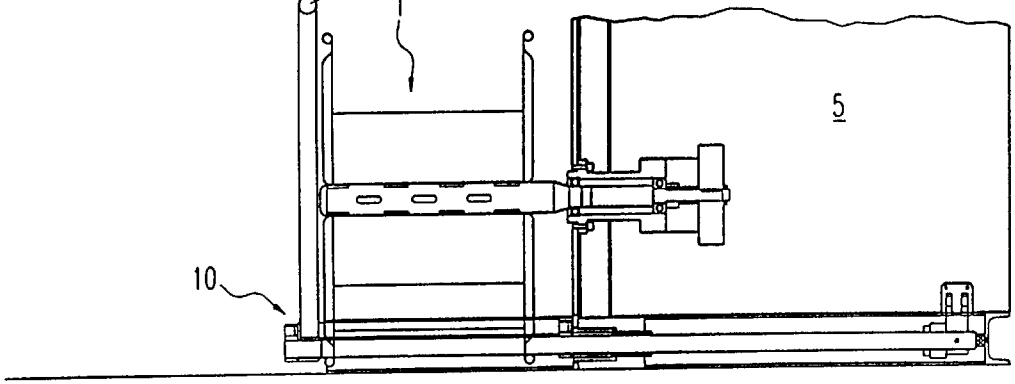
FIG. 4A illustrates the example apparatus as shown in FIG. 3A, with the doffing carriage retracted towards a winding machine of the apparatus.
Figure 5B:
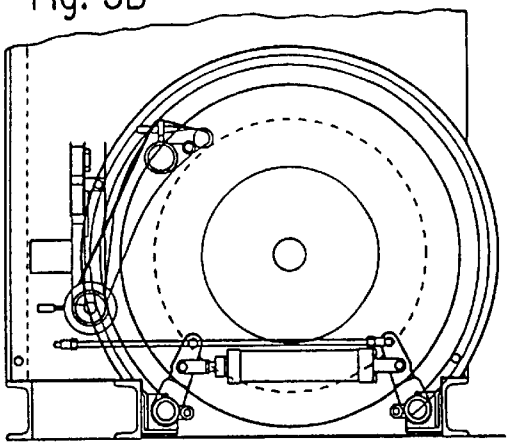
FIG. 5B is a side view of the embodiment shown in FIG. 5A.

In order to grip and lift the bobbin 1, the operator grasps the handle 35 and pulls the doffing carriage out of the winding machine 5 until the handle 35 has passed beyond the outer flange 2 of the bobbin 1. Now the lifting cylinder 27 is actuated and extends so that the right lever 22 is pivoted clockwise and the left lever 21, counterclockwise. The telescopic rods 33 and 34 transmit this pivoting movement to the gripping ends 23, 24, which are constructed as rotatable rollers, so that the bobbin 1 is raised as shown in FIG. 3A. Now the doffing carriage 10 is pushed inward towards the winding machine 5 by means of its handle 35, as shown in FIG. 4A, 4B. The chuck is then tensioned by way of calipers so that the flanged bobbin is seated firmly thereon. The gripping ends 23, 24 are lowered by appropriate actuation of the lifting cylinder 27 (the piston of which is retracted). The material to be wound is applied manually and the traversing arm 8 is pivoted inward. This condition is shown in FIG. 5B. Now the winding process can begin.

Figure 6B:
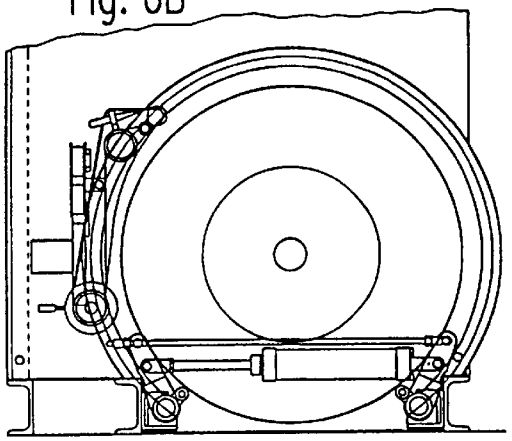
FIG. 6B is a side view of the embodiment shown in FIG. 6A.
Figure 5A:
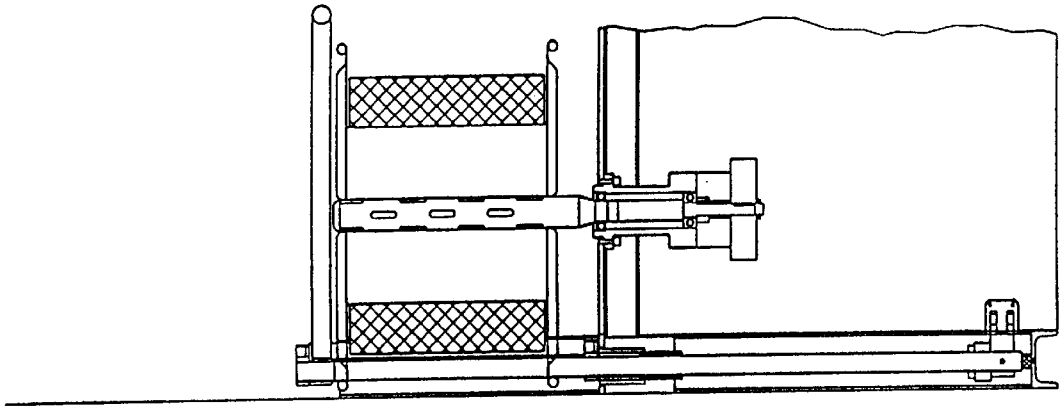
FIG. 5A illustrates the example apparatus as shown in FIG. 4A, with a traversing arm of the winding machine pivoted inwardly.
Figure 6A:
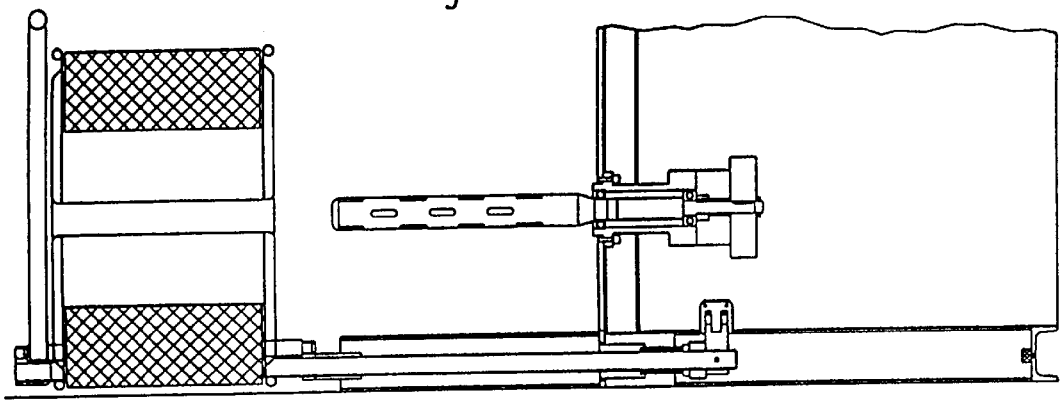
FIG. 6A illustrates the example apparatus as shown in FIG. 5A, with the doffing carriage re-extended.

As soon as the bobbin is full, the lifting cylinder 27 is again actuated, so that the gripping ends 23, 24 of the levers 21, 22 are swiveled upward, with the result that the bobbin is raised. The tensioning means 7 of the chuck 6 is opened, so that the chuck 6 releases the flanged bobbin 1. Now the doffing carriage 10 together with the wound bobbin 1 is pulled out, as shown in FIGS. 6A and 6B.

Figure 7B:
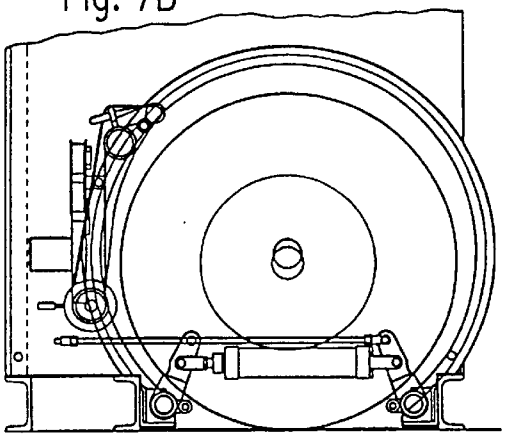
FIG. 7B is a side view of the embodiment shown in FIG. 7A.
Figure 8B:
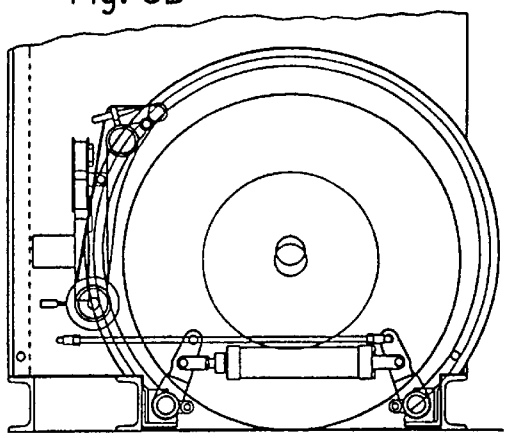
FIG. 8B is a side view of the embodiment shown in FIG. 8A.
Figure 7A:
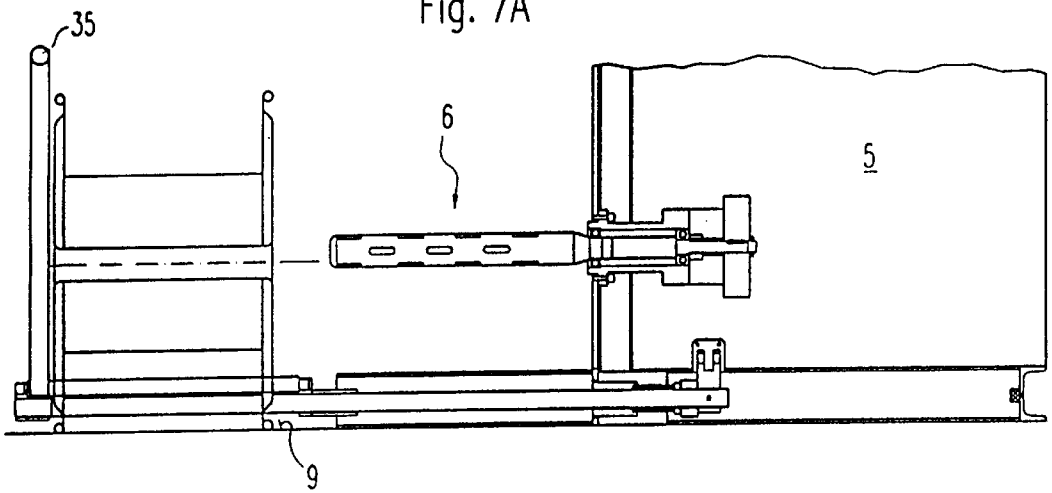
FIG. 7A illustrates the example apparatus as shown in FIG. 6A, with the bobbin seated on the ground.
Figure 8A:
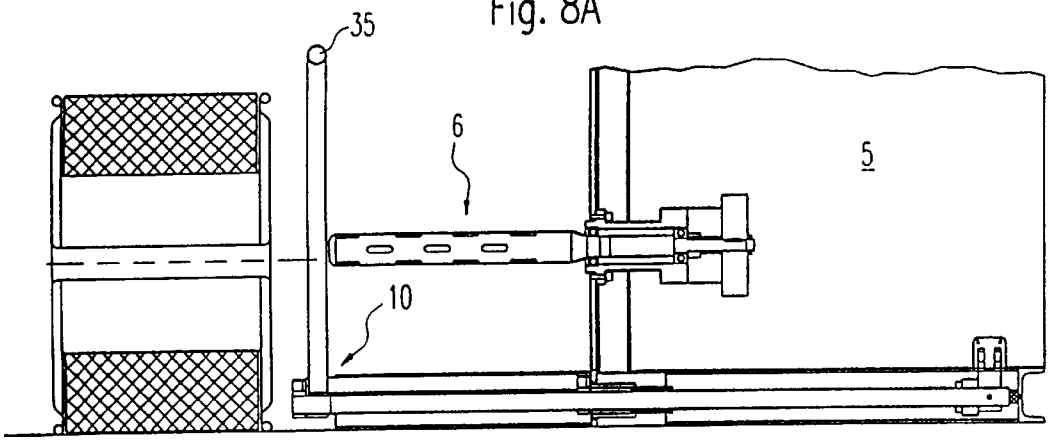
FIG. 8A illustrates the example apparatus as shown in FIG. 7A, with the doffing carriage retracted.

In order to lower the wound flanged bobbin 1, the lifting cylinder 27 is again actuated, so that the right lever 22 pivots counterclockwise and the left lever 21 pivots clockwise. The package is now seated on a floor, conveyor belt, carriage, or other similar support or transport system 11 which may be part of the floor 9, by way of the spool flanges 2, 3, as shown in FIG. 7A, 7B. Now the doffing carriage 10 is pushed inward, towards the winding machine 5, until the telescopic rods strike their stops. The wound flanged bobbin 1 can then be rolled away, still resting directly on the floor.

The gripping ends 23, 24 are preferably constructed as rollers such that when the levers 21, 22 are pivoted, they roll along the circumference of the flanges 2, 3 so as to minimize both the operating forces involved and the frictional wear.

LIST OF REFERENCE NUMERALS

1 Flanged bobbin
2 Outer flange
3 Inner flange
5 Winding machine
6 Winding chuck
7 Tensioning means
8 Traversing arm
9 Floor
10 Doffing carriage
20 Lifting device
21 First lever
22 Gripping end
24 Gripping end
25 Actuating end
26 Actuating end
27 Lifting cylinder
30 Guide mechanism
31 First bearing
32 Second bearing
33 Telescopic rod
34 Telescopic rod
35 Handle

What is claimed is:

1. Apparatus for manipulating a flanged bobbin (1) at a winding machine (5), comprising a doffing carriage (10) with lifting devices (20) to raise and lower the bobbin (1) between a winding height, at which the bobbin (1) can be pushed onto and pulled off a chuck (6) of the winding machine, and a transport height, at which a wound bobbin can be rolled;

a guide mechanism (30) for low-friction guidance of the doffing carriage (10) with and without the bobbin (1) in a transport direction parallel to the chuck (6), between a winding position for winding the bobbin and a transport position in which the bobbin (1) is transported to and away from the machine, such that the guide mechanism (30) is fixedly attached to the winding machine (5) at least in the transport direction and is so constructed that when in the winding position, the lifting devices (20) are in the region of flanges (2), the lifting devices (20) being so constructed that when the flanged bobbin (1) is in the transport position, they release said bobbin and can be pushed into the winding position.

2. Apparatus according to claim 1, characterized in that the lifting device (20) is so constructed as to grip and support a flanged bobbin by its flanges (2, 3).

3. Apparatus according to claim 1, characterized in that the guide mechanisms (30) comprise straight guides (31–34), wherein guide rods are so mounted that they can be moved out of the winding machine (5).

4. Apparatus according to claim 1, characterized in that the lifting devices for each flange (2) comprise a pair of levers (21, 22) pivotably attached to the doffing carriage (10), which with gripping ends (23, 24) movably engage the flanges (2, 3) in the circumferential direction thereof and with their actuating ends (25, 26) can be moved by a common lifting cylinder (27) in order to raise and lower the flanged bobbin (1).

5. Apparatus according to claim 4, characterized in that the gripping ends (23, 24) are constructed as low-friction supporting devices, which extend in the direction of the chuck (6), and that the second actuating ends (25, 26) are disposed within the winding machine (5).

6. Apparatus according to claim 5, characterized in that the actuating ends (25, 26), in order to pivot the gripping ends (23, 24), are connected with the latter in a rotationally stable manner by way of the guide mechanism (30).

7. Apparatus according to claim 1, characterized in that the doffing carriage (10) comprises a handle (35) by means of which the doffing carriage is manually shifted.

8. Apparatus according to claim 7, characterized in that the handle (35) is a frame-like structure that connects to one another ends of the guide mechanism (30) in the form of straight guides (31–34) that project out of the winding machine (5).

9. Apparatus according to claim 7, characterized in that the handle (35) is constructed substantially in the shape of a section of a ring and has a diameter larger than that of the flanges (2, 3), so that the handle (35) can be moved over the flanged bobbin (1) in an axial direction when the flanged bobbin (1) is seated on a floor (9).

10. Apparatus according to claim 1, characterized in that the lifting devices (20) are so constructed as to deposit the flanged bobbin onto a transport system.

11. Apparatus according to claim 10, wherein the transport system is a conveyor belt.

12. Apparatus according claim 10, wherein the transport system is a carriage.

13. Apparatus according to claim 1, wherein the wound bobbin is rolled while resting on a floor (9) in front of the winding machine.

14. Apparatus according to claim 1, wherein the wound bobbin is rolled while resting on a conveyor belt running in front of the winding machine.

* * * * *